US010495995B2

(12) United States Patent
Morooka et al.

(10) Patent No.: US 10,495,995 B2
(45) **Date of Patent: *Dec. 3, 2019**

(54) IMAGE FORMING APPARATUS

(71) Applicant: FUJI XEROX CO., LTD., Tokyo (JP)

(72) Inventors: Yasuhisa Morooka, Kanagawa (JP); Naoki Ota, Kanagawa (JP); Makoto Kamisaki, Kanagawa (JP); Tatsuhiro Igarashi, Kanagawa (JP); Jun Sekiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/112,798

(22) Filed: Aug. 27, 2018

(65) Prior Publication Data

US 2019/0294065 A1 Sep. 26, 2019

(30) Foreign Application Priority Data

Mar. 20, 2018 (JP) ..... 2018-053137

(51) Int. Cl.
*G03G 9/087* (2006.01)
*G03G 9/08* (2006.01)
*G03G 15/20* (2006.01)

(52) U.S. Cl.
CPC ..... *G03G 9/08755* (2013.01); *G03G 9/0819* (2013.01); *G03G 15/2053* (2013.01)

(58) Field of Classification Search
CPC ..... G03G 9/0819
See application file for complete search history.

(56) References Cited

U.S. PATENT DOCUMENTS

| | | | | |
|---|---|---|---|---|
| 4,264,697 | A | 4/1981 | Perez et al. | |
| 5,621,512 | A | 4/1997 | Uehara et al. | |
| 2014/0322643 | A1* | 10/2014 | Watanabe | G03G 9/0806 430/109.4 |

FOREIGN PATENT DOCUMENTS

| | | | |
|---|---|---|---|
| JP | S56-11461 | | 2/1981 |
| JP | S62-39879 | | 2/1987 |
| JP | H08-262903 | | 10/1996 |
| JP | H10-20692 | | 1/1998 |
| JP | 10268558 | A * | 10/1998 |
| JP | 10268685 | A * | 10/1998 |
| JP | 2005-195689 | | 7/2005 |

OTHER PUBLICATIONS

English Translation JP-10268558-A, Oct. 1998. Ito (Year: 1998).*

* cited by examiner

*Primary Examiner* — Ryan D Walsh
(74) *Attorney, Agent, or Firm* — JCIPRNET

(57) ABSTRACT

An image forming apparatus includes an image holding member; a charging unit; an electrostatic image forming unit; a developing unit; a transfer unit; and a fixing unit that fixes the toner image on the recording medium. The toner has an amorphous polyester resin and has a weight-average molecular weight Mw in a range of 25,000 to 60,000, a ratio Mw/Mn is within a range of 5 to 10, a ratio of an absorbance at a wavenumber of 1500 $cm^{-1}$ to an absorbance at a wavenumber of 720 $cm^{-1}$ is 0.6 or less, and a ratio of an absorbance at a wavenumber of 820 $cm^{-1}$ to the absorbance at a wavenumber of 720 $cm^{-1}$ is 0.4 or less. The fixing unit includes a heat roll having an elastic component, an endless belt and a pressure pad that is disposed on an inner side of the endless belt.

9 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2018-053137 filed Mar. 20, 2018.

BACKGROUND

(i) Technical Field

The present invention relates to an image forming apparatus.

(ii) Related Art

A method, such as an electrophotographic method, for visualizing image information through forming electrostatic images are now being utilized in various fields. In an electrophotographic method, visualization is realized through forming an electrostatic image (latent image) on an image holding member by performing a charging step and an exposing step (electrostatic image forming step), developing the electrostatic image by using an electrostatic image-developing developer (hereinafter may simply be referred to as the "developer") that contains an electrostatic image-developing toner (hereinafter may simply be referred to as the "toner) (developing step), transferring the developed toner image onto a transfer-receiving member (transfer step), and fixing the toner image on the transfer-receiving member by using a fixing device equipped with a heating roll and a pressure roll, and the like (fixing step).

SUMMARY

According to an aspect of the invention, there is provided an image forming apparatus that includes an image holding member; a charging unit that charges a surface of the image holding member; an electrostatic image forming unit that forms an electrostatic image on the charged surface of the image holding member; a developing unit that contains an electrostatic image developer and develops the electrostatic image on the surface of the image holding member by using the electrostatic image developer so as to form a toner image; a transfer unit that transfers the toner image on the surface of the image holding member onto a surface of a recording medium; and a fixing unit that fixes the toner image on the recording medium. The electrostatic image developer contains a toner, which contains an amorphous polyester resin as a binder resin. A tetrahydrofuran-soluble component of toner particles has a weight-average molecular weight Mw in a range of 25,000 to 60,000, and a ratio Mw/Mn of the weight-average molecular weight Mw to a number-average molecular weight Mn of the tetrahydrofuran-soluble component is within a range of 5 to 10. A ratio of an absorbance of the toner particles at a wavenumber of 1500 $cm^{-1}$ to an absorbance of the toner particles at a wavenumber of 720 $cm^{-1}$ is 0.6 or less. A ratio of an absorbance of the toner particles at a wavenumber of 820 $cm^{-1}$ to the absorbance of the toner particles at a wavenumber of 720 $cm^{-1}$ is 0.4 or less. The fixing unit includes a heat roll that has an elastic component and is rotatable, an endless belt that contacts the heat roll, and a pressure pad that is disposed on an inner side of the endless belt and is in a non-rotatable state.

BRIEF DESCRIPTION OF THE DRAWINGS

Exemplary embodiments of the present invention will be described in detail based on the following figures, wherein.

DETAILED DESCRIPTION

The exemplary embodiments of the invention will now be described. These exemplary embodiments are merely examples of implementing the invention and are not to be construed as limiting.

Fixing Device

Figure 1:
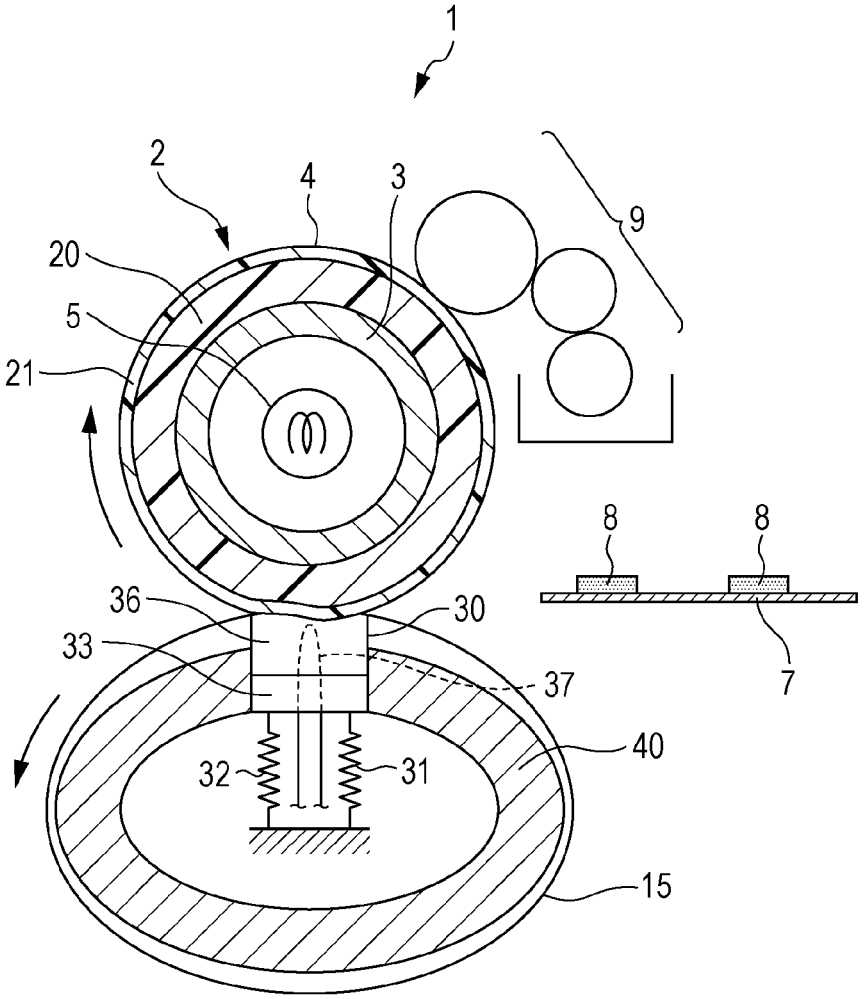
FIG. 1 is a schematic diagram illustrating one example of a fixing device of an image forming apparatus according to one exemplary embodiment of the invention.

FIG. 1 is a sectional side elevation illustrating a schematic structure of one example of a fixing device of an image forming apparatus according to one exemplary embodiment of the invention. A fixing device 1 includes a heat roll 2 that is rotatable and has an elastically deformable surface, an endless belt 15 capable of running while contacting the heat roll 2, and a pressure pad 30 that is in a non-rotatable state and is disposed on the inner side of the endless belt 15. The pressure pad 30 causes the endless belt 15 to pressure-contact the heat roll 2 so as to form a contact surface and a belt nip, through which a recording medium 7 serving as a transfer-receiving member is passed, between the endless belt 15 and the heat roll 2. The pressure pad 30 locally elastically deform the outlet side of the recording medium 7 in the surface of the heat roll 2.

The heat roll 2 includes, for example, a core 3, which is a cylinder composed of iron or the like; a base layer 20 formed of, for example, silicone rubber and formed on the surface of the core 3; and a top coat layer 21 formed of, for example, silicone rubber and formed on the surface of the base layer 20. The base layer 20 and the top coat layer 21 constitute a coating layer 4. The coating layer 4 is finished so that the surface is close to a mirror state, for example. The core 3 may be formed of a metal having high thermal conductivity other than iron. The coating layer 4 may be formed by using other elastic materials having high heat resistance.

For example, a halogen lamp 5 serving as a heat source is disposed inside the core 3. The temperature of the surface of the heat roll 2 is measured with a temperature sensor 37 described below. A temperature controller not illustrated in the drawing performs feedback control on the halogen lamp 5 on the basis of the measurement signal from the temperature sensor 37 so that the surface of the heat roll 2 is adjusted to a predetermined temperature.

An oil supplying device 9 is disposed near the heat roll 2. A particular amount of a releasing agent may be supplied to the surface of the heat roll 2 from the oil supplying device 9. In this manner, in fixing an unfixed image formed of a toner 8 onto the recording medium 7, offset of some of the toner 8 onto the heat roll 2 is suppressed.

The endless belt 15 is disposed below the heat roll 2. A guide 40, which is a guide member that rotatably supports the inner circumferential surface of the endless belt 15, is disposed at two end portions in the longitudinal direction of the endless belt 15. The endless belt 15 rotates around the guide 40 as the heat roll 2 rotates. The endless belt 15 is, for example, formed of a metal such as nickel, and is deformable at the belt nip between the heat roll 2 and the pressure pad 30 so as to correspond the deformation of the heat roll 2 and the pressure pad 30. The endless belt 15 can be formed of other metals as long as the stiffness is high and flexibility is appropriate. Occurrence of cockle, wrinkles, etc., in the endless belt 15 can be suppressed without applying a tension to the endless belt 15 by using a stretching roll. In this manner, compared to the case in which no guide member is disposed, the driven failure and fracture end portions of the endless belt can be suppressed compared to the case where no guide member is provided. Since a stretching roll used for stretching the endless belt is not needed, the equipment can be significantly simplified and miniaturized, and the cost can be reduced.

The endless belt 15 may have an elastic layer at the contact surface with the heat roll 2. Compared to the case in which no elastic layer is disposed, this structure can retain an appropriate pressure at the fixing nip and can suppress a paper jam, gloss nonuniformity, etc. The elastic layer is, for example, formed of a material such as a fluororesin. The elastic layer has a thickness of, for example, 0.02 mm or more and 0.05 mm or less.

In the example illustrated in FIG. 1, the guide 40 has an elliptical shape, but may have any other shape, for example, a circular shape, as long as the running of the endless belt 15 is not obstructed. The material for the guide 40 may be any material that has a particular degree of stiffness but does not excessively take away heat from the belt nip and does not obstruct the running of the endless belt 15. For example, a wire screen or a resin can be used to form the guide 40.

Flanges may be disposed at the two end portions of the guide 40 so that the endless belt 15 does not shift in one direction in the axis direction of the heat roll 2 and does not detach from the guide 40.

The pressure pad 30 is energized toward the center of the heat roll 2 by two compression coil springs 31 and 32, for example. The compression coil spring 31 is disposed to pressurize all parts of the belt nip. The compression coil spring 32 is disposed to pressurize the vicinity of the outlet of the belt nip so as to deform the surface of the heat roll 2 and enhance the self stripping performance of the recording medium 7.

Figure 2:
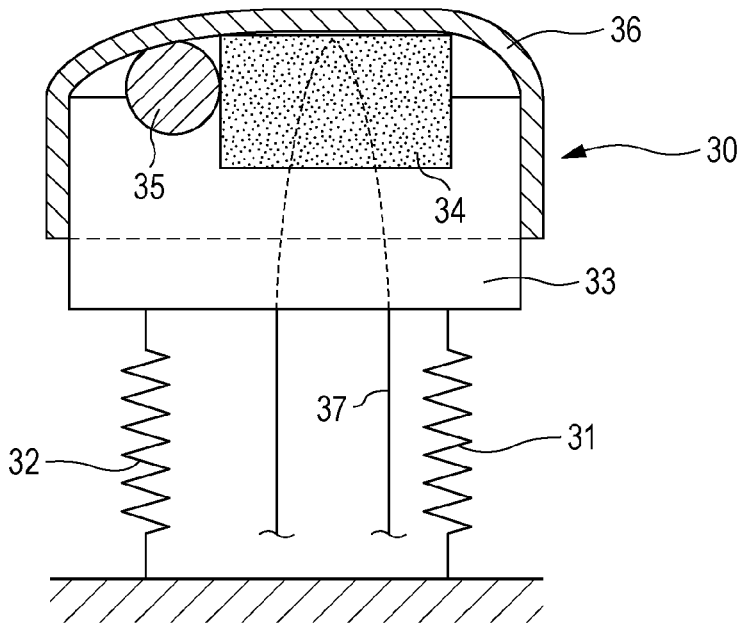
FIG. 2 is a schematic diagram illustrating one example of a pressure pad used in the fixing device of the image forming apparatus according to one exemplary embodiment of the invention.

FIG. 2 illustrates a schematic structure of one example of the pressure pad 30 used in the fixing device 1. The pressure pad 30 is equipped with a frame 33 formed of, for example, metal, supported on the compression coil springs 31 and 32. A soft member 34 and a hard member 35 are set in the surface of the frame 33 on the heat roll 2 side. The soft member 34 and the hard member 35 are covered with a low friction sheet 36. Here, the soft member 34 presses the endless belt 15 throughout substantially all parts of the belt nip; thus, for example, the soft member 34 is formed to have a flat plate shape along the length direction of the heat roll 2 by using a soft material such as silicone sponge (silicon rubber foam), for example. The hard member 35 is formed by using, for example, a stainless steel pipe, so as to have a columnar shape, and is harder than the coating layer 4 so that the coating layer 4 on the surface of the heat roll 2 is locally deformed to induce self stripping of the recording medium 7.

Here, since the soft member 34 is provided, the contact surface of the endless belt 15 that contacts the low friction sheet 36 can align with the outer circumferential surface of the heat roll 2. In other words, when the pressure pad 30 is pressed toward the heat roll 2 at a predetermined load, the soft member 34 deforms, and the contact surface of the low friction sheet 36 aligns with the outer circumferential surface of the heat roll 2. Due to the energizing force applied from the compression coil springs 31 and 32, substantially no gap is formed between the heat roll 2 and the endless belt 15 and between the endless belt 15 and the low friction sheet 36. The structure described above can locally elastically deform the outlet side of the recording medium 7 in the surface of the heat roll 2.

An example of the low friction sheet 36 is a glass fiber sheet impregnated with polytetrafluoroethylene. In this manner, the endless belt 15 smoothly slides on the pressure pad 30. Furthermore, a lubricant may be applied to the inner side of the endless belt 15. The heat roll 2 is rotated by a motor or the like not illustrated in the drawing at a predetermined peripheral velocity, and due to this rotation, the endless belt 15 is driven and rotated. The temperature sensor 37 is, for example, a thermocouple, and a tip thereof is embedded inside the soft member 34.

In FIG. 1, an image formed of the toner 8 is transferred onto the recording medium 7 by a transfer device not illustrated in the drawing, and this recording medium 7 is transported from the right side of the drawing in FIG. 1 toward the belt nip and enters the belt nip. Then, the pressure acting on the belt nip from the heat roll 2 and the pressure pad 30 and the heat applied through the heat roll 2 from the halogen lamp 5 fix the image formed of the toner 8 onto the recording medium 7 (fixing step).

Since the pressure pad 30 is in a non-rotatable state, the heat conducted from the heat roll 2 does not dissipate easily. Even when rotation of the heat roll 2 is started and the endless belt 15 is started to be driven and rotated, the amount of heat taken away from the heat roll 2 is small. Since the heat loss is small as such, this structure is economical, the temperature drop at the belt nip is decreased, and the fixability of the toner 8 is improved.

The temperature sensor 37 is disposed inside the pressure pad 30 facing the belt nip. In this manner, the temperature of the belt nip can be measured, and better temperature control is enabled. Moreover, wear and damage of the temperature sensor 37 caused by direct contact with the surface of the heat roll 2 are avoided.

According to the fixing device 1, the pressure pad 30 can press the endless belt 15 over a large area. Thus, the pressure distribution in the belt nip can be easily adjusted, and the pressing force of the compression coil spring 31 can be applied to substantially all parts of the belt nip by the pressure pad 30. Since the hard member 35 is hard, concentration of load occurs on the compression coil spring 32. Thus, the part of the coating layer 4 of the heat roll 2 pressed by the hard member 35 deforms, and the outlet side of the recording medium 7 in the surface of the heat roll 2 can be locally elastically deformed. Thus, high pressure can be applied after the toner 8 is heated with the heat roll 2, and, compared to a fixing device equipped with a heating roll and a pressure roll, the fixing time can be shortened, and the fixing temperature can be decreased. Thus, when a toner, which contains a polyester resin as a binder resin, has a Mw of 10,000 or more and 60,000 or less and a Mw/Mn of 5 or more and 10 or less, and has a ratio of a peak absorption at around 1500 $cm^{-1}$ to a peak absorption at around 720 $cm^{-1}$ of 0.6 or less and a ratio of a peak absorption at around 820 $cm^{-1}$ to a peak absorption at around 720 $cm^{-1}$ of 0.4 or less in infrared absorption spectrum analysis, is used in a high-temperature, high-humidity environment, hot offset can be suppressed compared to when a fixing device equipped with a heating roll and pressure roll is used. Moreover, degradation of rub resistance of the fixed image can be suppressed. As a result, the fixing latitude can be enlarged.

Since the hard member 35 is hard, concentration of load occurs on the compression coil spring 32. Thus, the part of the coating layer 4 of the heat roll 2 pressed by the hard member 35 deforms, and self stripping of the recording medium 7 becomes possible. Due to this distortion, the velocity at the pressed portion is higher than the peripheral velocity of other portions of the heat roll 2. Thus, when the leading end of the recording medium 7 passing the belt nip reaches the hard member 35, the velocity of the recording medium 7 increases by being affected by the velocity of the distorted portion of the heat roll 2.

However, since the pressure is applied to the belt nip from the entire pressure pad 30, in particular, the soft member 34, the trailing portion of the recording medium 7 is pressed, and thus the increase in velocity is little. In other words, the recording medium 7 moves at a velocity substantially equal to the peripheral velocity of other portions of the heat roll 2. As such, at the belt nip where the toner image is fixed, the difference in velocity between the heat roll 2 and the recording medium 7 is small, and misalignment of the image is very slight.

From the viewpoint of pressing the trailing portion of the recording medium 7, the pressure at the inlet side of the belt nip applied through the soft member 34 is to be large as possible. However, if the pressure is excessively large, it becomes difficult for the recording medium 7 to enter the belt nip, and the recording medium 7 entering the belt nip may undergo velocity fluctuation, which causes misalignment of the image.

In contrast, with this fixing device 1, since a flat plate shaped soft member 34 is disposed, the pressure on the inlet side of the recording medium 7 in the belt nip is smaller than the pressure on the outlet side. In this manner, while a fixing nip that applies the energy required for fixing is obtained, the releasing property can be assured, and the hot offset can be suppressed. Thus, the recording medium 7 smoothly enters the belt nip, and misalignment of the image can be suppressed. As described above, the velocity fluctuation of the recording medium 7 in the belt nip can be reduced, the difference in velocity between the heat roll 2 and the recording medium 7 can be decreased, and disturbance of the unfixed image formed of the toner 8 is suppressed so that the misalignment of the obtained fixed image can be suppressed.

Furthermore, since the pressure pad 30 presses the endless belt 15 throughout all parts of the belt nip, the endless belt 15 can be pressed against the heat roll 2 substantially without any gap throughout all parts of the belt nip. Thus, expansion and evaporation of air, water steam, etc., from the recording medium 7 and the toner 8 can be suppressed. Thus, generation and growth of air bubbles in the belt nip can be suppressed. Consequently, disturbance of the unfixed toner 8 by grown air bubbles can be suppressed, and the toner 8 on the recording medium 7 passing through the belt nip can be securely pressed down by using the endless belt 15 and the heat roll 2, and fixed. As described above, since evaporation etc., of water steam and air are suppressed, fixing can be performed while suppressing the disturbance of the image formed of the toner 8.

Figure 3:
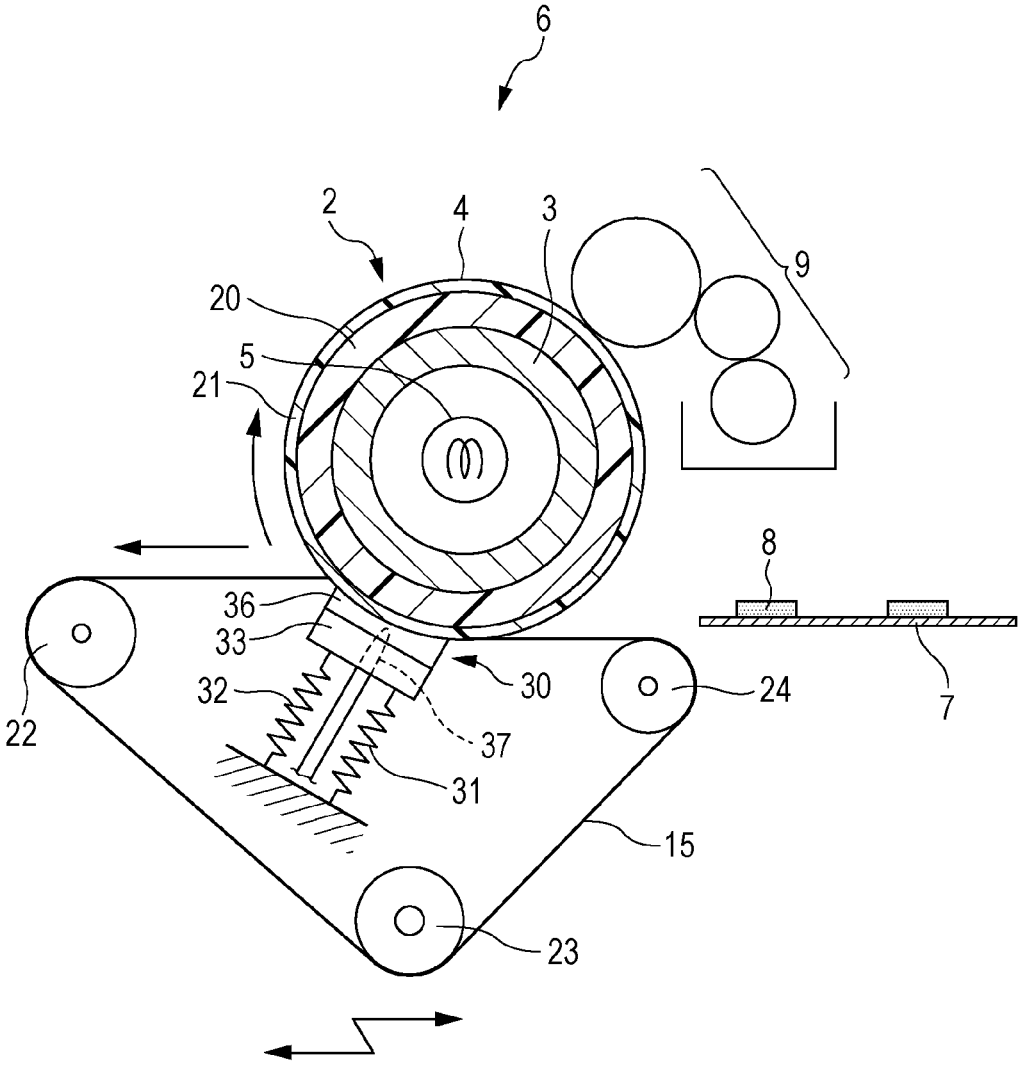
FIG. 3 is a schematic diagram illustrating another example of a fixing device of the image forming apparatus according to one exemplary embodiment of the invention.

FIG. 3 is a sectional side elevation illustrating a schematic structure of another example of a fixing device of an image forming apparatus of this exemplary embodiment. A fixing device 6 illustrated in FIG. 3 differs from the fixing device 1 illustrated in FIG. 1 in the endless belt 15 and the manner the endless belt 15 is supported, but is the same in that the pressure pad 30 is used. In the fixing device 1 illustrated in FIG. 1, the endless belt 15 runs around the guide 40. In the fixing device 6 illustrated in FIG. 3, the endless belt 15 is stretched over three rolls 22, 23, and 24.

In the fixing device 6 illustrated in FIG. 3, the endless belt 15 wound around rolls 22, 23, and 24 formed of, for example, stainless steel, is disposed below the heat roll 2. This endless belt 15 is formed of, for example, a polyimide film, and is stretched over the rolls 22, 23, and 24 at a predetermined tension. In order to suppress movement of the endless belt 15 in an axial direction of the rolls 22, 23, and 24 and to suppress detachment of the endless belt 15 from the rolls 22, 23, and 24, the roll 23 may be arranged to be slightly displaceable.

Because of the arrangement of these rolls 22, 23, and 24, the endless belt 15 contacts the heat roll 2 and is pressed against the heat roll 2 at a predetermined load from the pressure pad 30. As a result, a belt nip through which the recording medium 7 passes is formed between the endless belt 15 and the heat roll 2.

As with the fixing device 1 illustrated in FIG. 1, a pressure pad 30 in a non-rotatable state is disposed so that the outlet side of the recording medium 7 in the surface of the heat roll 2 can be locally elastically deformed. When the particular toner described above is used in a high-temperature, high-humidity environment, hot offset can be suppressed and degradation of rub resistance of the fixed image can be suppressed compared to the case in which a fixing device equipped with a heating roll and a pressure roll is used. As a result, the fixing latitude can be enlarged.

Moreover, reduction of heat loss at the belt nip, suppression of image misalignment due to the decreased velocity fluctuation of the recording medium 7 in the belt nip, and suppression of image misalignment due to suppression of air bubbles, etc., can be achieved. Moreover, the temperature sensor 37 built inside the pressure pad 30 also affords some advantage.

The fixing temperature in the fixing device 1 or 6 and applied to the toner used in the image forming apparatus of this embodiment may be 100° C. or higher and 200° C. or lower or may be 130° C. or higher and 190° C. or lower. When the fixing temperature is lower than 100° C., fixing failure may occur. When the fixing temperature exceeds 200° C., hot offset may occur.

Image Forming Apparatus

The image forming apparatus of this exemplary embodiment includes, for example, an image holding member, a charging unit that charges a surface of the image holding member, an electrostatic image forming unit that forms an electrostatic image on the charged surface of the image holding member, a developing unit that develops the electrostatic image on the surface of the image holding member by using a toner so as to form a toner image, a transfer unit that transfers the developed toner image onto a transfer-receiving member, and a fixing device serving as a fixing unit for fixing the toner image on the transfer-receiving member. If needed, the image forming apparatus of this exemplary embodiment may be equipped with an image holding member-cleaning unit that removes residual toner and the like remaining on the surface of the image holding member after the transfer so as to clean the image holding member.

The structure of the image forming apparatus of the exemplary embodiment will now be described with reference to the drawings; however, the present invention is not limited by the exemplary embodiment described below.

Figure 4:
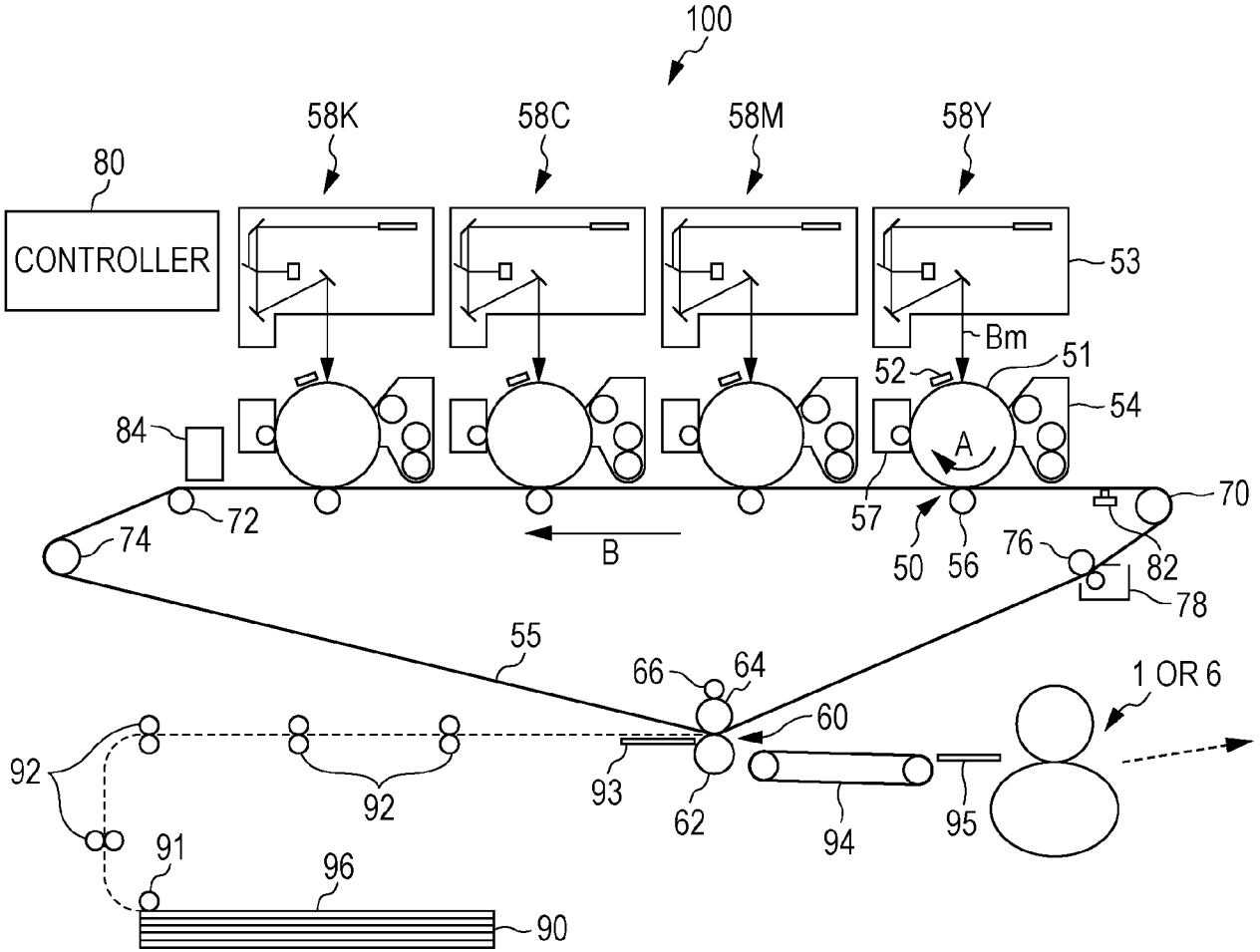
FIG. 4 is a schematic diagram illustrating one example of an image forming apparatus according to an exemplary embodiment of the invention.

FIG. 4 is a schematic diagram illustrating one example of the structure of an image forming apparatus of this exemplary embodiment. An image forming apparatus 100 illustrated in FIG. 4 includes image forming units 58Y, 58M, 58C, and 58K in which toner images of respective color components are electrophotographically formed; a first transfer unit 50 that sequentially transfers, onto an intermediate transfer belt 55, the toner images of the respective color components formed by the image forming units 58Y, 58M, 58C, and 58K (first transfer); a second transfer unit 60 that batch-transfers the superimposed toner images on the intermediate transfer belt 55 onto a recording medium (recording sheet) 96 (second transfer); and a fixing device 1 or 6 that fixes the second-transferred image to the recording medium 96. A controller 80 that controls the operation of the respective devices (units) is also provided.

In this embodiment, each of the image forming units 58Y, 58M, 58C, and 58K includes a photoreceptor drum 51 that rotates in the arrow A direction; and electrophotographic devices sequentially disposed around the photoreceptor drum. The electrophotographic devices are as follows: a charger 52 that charges the photoreceptor drum 51; a laser exposure device 53 (in FIG. 4, the exposure beam is represented by reference sign Bm) that writes an electrostatic latent image on the photoreceptor drum 51; a developing device 54 that contains a toner of the corresponding color component and visualizes the electrostatic latent image on the photoreceptor drum 51 by using the toner; a first transfer roll 56 that transfers, onto the intermediate transfer belt 55, the toner image formed on the photoreceptor drum 51 in the first transfer unit 50; and a drum cleaner 57 that removes the residual toner on the photoreceptor drum 51. The image forming units 58Y, 58M, 58C, and 58K are arranged in a substantially straight line in the order of yellow (Y), magenta (M), cyan (C), and black (K) from the upstream side of the intermediate transfer belt 55.

The intermediate transfer belt 55, which serves as an intermediate transfer body, is formed of, for example, a film-shaped endless belt in which an appropriate amount of an antistatic agent, such as carbon black, is added to a resin, such as polyimide or polyamide. The volume resistivity of the intermediate transfer belt 55 is, for example, $10^6$ Ωcm or more and $10^{14}$ Ωcm or less, and the thickness thereof is about 0.1 mm. The intermediate transfer belt 55 is driven to circulate at a predetermined velocity in the B direction illustrated in FIG. 4 owing to various types of rolls (rotation driving). In this exemplary embodiment, the various type of rolls are a driving roll 70 that is driven by a motor (not illustrated) having excellent constant-velocity properties and thereby rotates the intermediate transfer belt 55; a supporting roll 72 that supports the intermediate transfer belt 55 extending along the direction in which the photoreceptor drums 51 are arranged; a tension roll 74 that applies a tension to the intermediate transfer belt 55 and functions as a correction roll that prevents meandering of the intermediate transfer belt 55 and the like; a backup roll 64 installed in the second transfer unit 60; and a cleaning backup roll 76 installed in a cleaning unit that scrapes off the residual toner on the intermediate transfer belt 55.

The first transfer unit 50 is formed of a first transfer roll 56 arranged to oppose the photoreceptor drum 51 with the intermediate transfer belt 55 therebetween. The first transfer roll 56 is, for example, formed of a shaft (not illustrated) and a sponge layer (not illustrated) that is fixed to the periphery of the shaft and serves as an elastic layer. The shaft is, for example, a columnar rod composed of a metal such as iron or SUS. The sponge layer is, for example, a sponge-like cylindrical roll having a volume resistivity of, for example, $10^7$ Ωcm or more and $10^9$ Ωcm or less and formed of a blend rubber containing acrylonitrile-butadiene rubber (NBR), styrene-butadiene rubber (SBR), and ethylene-propylene-diene rubber (EPDM), and a conductive agent such as carbon black. The first transfer roll 56 is arranged to be in pressure-contact with the photoreceptor drum 51 with the intermediate transfer belt 55 therebetween, and a voltage (first transfer bias) having an opposite polarity to the toner charging polarity (minus polarity, the same applies hereinafter) is applied to the first transfer roll 56. In this manner, the toner images on the photoreceptor drums 51 are sequentially electrostatically attracted to the intermediate transfer belt 55 so as to form a superimposed toner image on the intermediate transfer belt 55.

The second transfer unit 60 is formed of a second transfer roll 62 arranged on the toner image-holding surface side of the intermediate transfer belt 55, and the backup roll 64. The backup roll 64 has a surface formed of, for example, a tube composed of a EPDM-NBR blend rubber with carbon or the like dispersed therein, and an interior composed of, for example, EPDM rubber. The backup roll 64 is formed so that the surface resistivity is, for example, $10^7$Ω/□ or more and $10^{10}$Ω/□ or less, and the hardness is set to, for example, 70° (Asker C, produced by Kobunshi Keiki Co., Ltd., the same applies hereinafter). This backup roll 64 is disposed on the rear surface side of the intermediate transfer belt 55 so as to function as a counter electrode for the second transfer roll 62, and a power feed roll 66 composed of metal or the like for applying a second transfer bias is arranged to be in contact with the backup roll 64.

Meanwhile, the second transfer roll 62 is, for example, formed of a shaft (not illustrated) and a sponge layer (not illustrated) that is fixed on the periphery of the shaft and serves as an elastic layer. The shaft is, for example, a rod having a columnar shape or the like and composed of a metal such as iron or SUS. The sponge layer is, for example, a roll having a sponge texture or the like and a cylindrical shape or the like, having a volume resistivity of, for example, $10^7$ Ωcm or more and $10^9$ Ωcm or less, and formed of a NBR-SBR-EPDM blend rubber containing a conductive agent such as carbon black, for example. The second transfer roll 62 is arranged to be in pressure-contact with the backup roll 64 with the intermediate transfer belt 55 therebetween, and is earthed so that the second transfer bias is formed between the second transfer roll 62 and the backup roll 64. As a result, a toner image is transferred (second transfer) onto the recording medium 96 transported to the second transfer unit 60.

An intermediate transfer belt cleaner 78 that removes residual toner, paper dust, etc., on the intermediate transfer belt 55 after the second transfer and cleans the surface of the intermediate transfer belt 55 is disposed on the downstream of the second transfer unit 60 of the intermediate transfer belt 55. The intermediate transfer belt cleaner 78 is detachable from and attachable to the intermediate transfer belt 55. In this exemplary embodiment, a reference sensor (home position sensor) 82 that generates a reference signal for controlling the image formation timing in the image forming units 58Y, 58M, 58C, and 58K is disposed upstream of the yellow image forming unit 58Y. An image density sensor 84 for adjusting the image quality is disposed downstream of the black image forming unit 58K. The reference sensor 82 generates a reference signal by recognizing a mark on the rear side of the intermediate transfer belt 55, and the image forming units 58Y, 58M, 58C, and 58K start image formation when the controller 80 sends commands on the basis of recognition of the reference signal.

Furthermore, in the image forming apparatus 100 of this exemplary embodiment, the sheet feeder system includes, for example, a sheet tray 90 that accommodates the recording medium 96, a pickup roll 91 that takes out the recording medium 96 from a stack in the sheet tray 90 and feeds the recording medium 96, a feeder roll 92 that feeds the recording medium 96 picked up by the pickup roll 91, a feeder chute 93 that sends the recording medium 96 fed by the feeder roll 92 to the second transfer unit 60, a feeder belt 94 that feeds the recording medium 96 to the fixing device 1 or 6 after the second transfer by the second transfer roll 62, and a fixing inlet guide 95 that guides the recording medium 96 to the fixing device 1 or 6.

Next, a basic image forming process carried out in the image forming apparatus 100 of this exemplary embodiment is described. According to the image forming apparatus 100 illustrated in FIG. 4, image data output from an image reader (image input terminal (III)) (not illustrated) or a personal computer (PC) (not illustrated) is subjected to image processing by using an image processing system (IPS) (not illustrated), and then image forming operation is executed in the image forming units 58Y, 58M, 58C, and 58K. Specifically, in the IPS, the input reflectance data is subjected to particular image processing, such as various types of image editing including shading correction, misalignment correction, brightness/color space conversion, gamma correction, frame deletion, color editing, and moving. The image data subjected to image processing is converted into color material tone data of four colors, namely, Y, M, C, and K, and output to the laser exposure device 53.

In the laser exposure device 53, for example, in response to the input color material tone data, exposure beams Bm emitted from semiconductor lasers respectively irradiate the photoreceptor drums 51 of the image forming units 58Y, 58M, 58C, and 58K. After the surfaces of the photoreceptor drums 51 in the image forming units 58Y, 58M, 58C, and 58K are charged by the chargers 52, the surfaces are scanned and exposed with the laser exposure devices 53 so as to form electrostatic latent images. The formed electrostatic latent images are developed into toner images of four colors, namely, Y, M, C, and K, in the image forming units 58Y, 58M, 58C, and 58K.

The toner images formed on the photoreceptor drums 51 in the image forming units 58Y, 58M, 58C, and 58K are transferred onto the intermediate transfer belt 55. This transfer occurs at the first transfer unit 50 where the photoreceptor drum 51 contacts the intermediate transfer belt 55. More specifically, at the first transfer unit 50, the first transfer roll 56 applies, to the substrate of the intermediate transfer belt 55, a voltage (first transfer bias) having a polarity opposite to the toner charging polarity (minus polarity), and the toner images are sequentially superimposed on the surface of the intermediate transfer belt 55 so as to carry out the first transfer.

After the toner images are sequentially transferred (first transfer) onto the surface of the intermediate transfer belt 55, the intermediate transfer belt 55 moves so as to transport the toner images to the second transfer unit 60. When the toner images are transported to the second transfer unit 60, the pickup roll 91 of the sheet feeder system rotates in synchronization with the timing of transporting the toner images to the second transfer unit 60 so as to feed the recording medium 96, which is a paper size of a predetermined sheet, from the sheet tray 90. The recording medium 96 fed by the pickup roll 91 is transported by the feeder roll 92, passes through the feeder chute 93, and reaches the second transfer unit 60. Before reaching the second transfer unit 60, the recording medium 96 makes a temporary stop. A resist roll (not illustrated) rotates in synchronization with the timing of the movement of the intermediate transfer belt 55 retaining the toner images so that the position of the recording medium 96 and the positions of the toner images are aligned.

In the second transfer unit 60, the second transfer roll 62 is pressed against the backup roll 64 with the intermediate transfer belt 55 therebetween. At this stage, the recording medium 96 fed at the synchronized timing is tucked between the intermediate transfer belt 55 and the second transfer roll 62. Here, when a voltage (second transfer bias) having the same polarity as the toner charging polarity (minus polarity) is applied from the power feed roll 66, a transfer electric field is formed between the second transfer roll 62 and the backup roll 64. The unfixed toner images retained on the intermediate transfer belt 55 are electrostatically transferred onto the recording medium 96 at the second transfer unit 60 where the images are pressed by the second transfer roll 62 and the backup roll 64.

Subsequently, the recording medium 96 having the electrostatically transferred toner images thereon is transported as is while being detached from the intermediate transfer belt 55 by the second transfer roll 62, and is then transported to the feeder belt 94 downstream of the second transfer roll 62 in the sheet feeding direction. The feeder belt 94 transports the recording medium 96 to the fixing device 1 or 6 at a feeding velocity optimum for the fixing device 1 or 6.

The unfixed toner images on the recording medium 96 fed to the fixing device 1 or 6 are fixed to the recording medium 96 by being subjected to a fixing process involving heat and pressure in the fixing device 1 or 6, as described above. The recording medium 96 having the fixed image thereon is fed to a discharged sheet receiving unit of a discharge unit of the image forming apparatus.

Meanwhile, after the transfer to the recording medium 96 is completed, the residual toner and the like remaining on the intermediate transfer belt 55 are transported to the cleaning unit as the intermediate transfer belt 55 rotates, and are removed from the intermediate transfer belt 55 by the cleaning backup roll 76 and the intermediate transfer belt cleaner 78.

Compared to an image forming apparatus equipped with a fixing derive having a heating roll and a pressure roll, the image forming apparatus of the exemplary embodiment can enlarge the fixing latitude when a toner, which contains a polyester resin as a binder resin, has a toner tetrahydrofuran-soluble component having a Mw of 10,000 or more and 60,000 or less and a Mw/Mn of 5 or more and 10 or less, and has a ratio of a peak absorption at around 1500 $cm^{-1}$ to a peak absorption at around 720 $cm^{-1}$ of 0.6 or less and a ratio of a peak absorption at around 820 $cm^{-1}$ to a peak absorption at around 720 $cm^{-1}$ of 0.4 or less in infrared absorption spectrum analysis, is used in a high-temperature, high-humidity environment.

Toner for Developing Electrostatic Images

The toner used in the image forming apparatus of this exemplary embodiment contains a polyester resin as a binder resin. When the weight-average molecular weight and the number-average molecular weight of the tetrahydrofuran-soluble component of the toner measured by gel permeation chromatography are assumed to be Mw and Mn, respectively, Mw is 10,000 or more and 60,000 or less and the ratio (Mw/Mn) of the Mw to the Mn is 5 or more and 10 or less. When the toner is subjected to infrared absorption spectrum analysis, the ratio of a peak absorption at around 1500 $cm^{-1}$ to a peak absorption at around 720 $cm^{-1}$ is 0.6 or less, and the ratio of a peak absorption at around 820 $cm^{-1}$ to a peak absorption at around 720 $cm^{-1}$ of 0.4 or less.

Binder Resin

The toner of the exemplary embodiment contains a polyester resin as a binder resin. A main component of the binder resin may be a polyester resin. The polyester resin may be a crystalline polyester resin, an amorphous polyester resin, or a mixture of a crystalline polyester resin and an amorphous polyester resin. The polyester resin is synthesized from an acid component monomer (polyvalent carboxylic acid) and an alcohol component monomer (polyhydric alcohol). In this exemplary embodiment, an "acid-derived structural component" refers to a structural segment that has served as an acid component before synthesis of the polyester resin, and an "alcohol-derived structural component" refers to a structural segment that has served as an alcohol component before synthesis of the polyester resin. The main component refers to a component, amount of which is 50 parts by mass or more relative to 100 parts by mass of the binder resin in the toner.

Here, the "crystalline" as in the "crystalline resin" means having a clear endothermic peak instead of stepwise endothermic changes in differential scanning calorimetry (DSC) of the resin or the toner. Specifically, it is determined that there is a "clear" endothermic peak if the temperature from the onset point to the peak top of the endothermic peak is within 10° C. during re-heating at 10° C./min performed after cooling with liquid nitrogen after heating at a heating rate of 10° C./min, as measured by differential scanning calorimetry (DSC) by using a differential scanning calorimeter (name of instrument: type DSC-50) produced by Shimadzu Corporation equipped with an automatic tangent processing system. In a DSC curve, a point in a flat portion of the baseline and a point in a flat portion of a portion rising from the baseline are designated, and the intersection point of the tangent lines of the flat portions between the two designated points is determined as the "onset point" by the automatic tangent processing system. In contrast, a resin that does not have a clear endothermic peak but undergoes step-wise endothermic changes is an "amorphous resin", which is solid at room temperature and becomes thermoplastic at a temperature equal to or higher than the glass transition temperature. In differential scanning calorimetry (DSC), the "amorphous resin" does not have an endothermic peak corresponding to the crystal melting point other than the step-wise endothermic points corresponding to glass transition.

Acid-Derived Structural Component

The acid-derived structural component is not particularly limited, and examples thereof include aliphatic dicarboxylic acids and aromatic carboxylic acids. Examples of the aliphatic dicarboxylic acids include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters and acid anhydrides thereof. Examples of the aromatic carboxylic acids include lower alkyl esters and acid anhydrides of aromatic carboxylic acids, such as terephthalic acid, isophthalic acid, phthalic anhydride, trimellitic anhydride, pyromellitic acid, and naphthalene dicarboxylic acid. Examples also include alicyclic carboxylic acids such as cyclohexane dicarboxylic acid. In order to obtain better fixability and obtain a crosslinked structure or a branched structure, a trivalent or higher carboxylic acid (for example, trimellitic acid or an acid anhydride thereof) may be used in combination with a dicarboxylic acid. Specific examples of the alkenyl succinic acids include dodecenysuccinic acid, dodecylsuccinic acid, stearylsuccinic acid, octylsuccinic acid, and octenylsuccinic acid.

Alcohol-Derived Structural Component

The alcohol-derived structural component is not particularly limited, and examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanedecanediol. Furthermore, diethylene glycol, triethylene glycol, neopentyl glycol, glycerin, alicyclic diols such as cyclohexanediol, cyclohexanedimethanol, and hydrogenated bisphenol A, and aromatic diols such as an ethylene oxide adduct of bisphenol A and a propylene oxide adduct of bisphenol A are used. In order to obtain good fixability and obtain a crosslinked structure or a branched structure, a trihydric or higher alcohol (glycerin, trimethylolpropane, or pentaerythritol) may be used in combination with a diol.

In order to fulfil the Mw and Mw/Mn of the tetrahydrofuran-soluble component and the requirements of the peak absorptions in the infrared absorption spectrum analysis of the toner described above, the toner of the exemplary embodiment may be a toner that contains a bisphenol structural component-free polyester resin free of any bisphenol derivative such as bisphenol A as the alcohol-derived structural component. The toner may be a toner that contains a bisphenol structural component-free polyester resin that contains an aliphatic polyhydric alcohol as the structural component. In other words, of the alcohol-derived structural components described above, hydrogenated bisphenol A, an ethylene oxide adduct of bisphenol A, and a propylene oxide adduct of bisphenol A may be avoided.

A bisphenol derivative, such as bisphenol A, is an alcohol component monomer having high hydrophobicity, and a bisphenol structural component-free polyester resin typically has a high ester group concentration and provides cracking resistance to the fixed image when this resin is used as a binder resin in the toner. Meanwhile, when a toner that contains a bisphenol structural component-free polyester resin as a binder resin is left standing in a high-temperature, high-humidity environment, the decrease in surface elastic modulus of the toner is large compared to a toner that contains a bisphenol structural component-containing polyester resin that contains a bisphenol derivative as the alcohol-derived structural component. Therefore, when a toner that contains a bisphenol structural component-free polyester resin is used, in the fixing step that uses the heating roll and the pressure roll, hot offset (a phenomenon in which the resin on the toner surface melts excessively and the toner sticks to the heating roll) may occur at a temperature so high as to cause even the central portion of the toner to melt. Meanwhile, at a temperature so low as to not cause the center portion of the toner to melt, the resin in the center portion of the toner rarely melts, and the rub resistance of the fixed image may be degraded, resulting in a narrow fixing latitude.

However, when this toner is used in a high-temperature, high-humidity environment by using the fixing device described above, hot offset can be suppressed and degradation of rub resistance of the fixed image can be suppressed compared to the case in which a fixing device equipped with a heating roll and a pressure roll is used. As a result, the fixing latitude can be enlarged.

The method for producing the polyester resin is not particularly limited. A typical polyester polymerization method that involves reacting an acid component with an alcohol component may be employed. Examples of the method include a direct polycondensation method and a transesterification method, and an appropriate method may be employed for production according to the types of monomers used. The molar ratio (acid component/alcohol component) in reacting the acid component with the alcohol component differs depending on the reaction conditions, etc., and cannot be categorically determined. However, typically, the molar ratio is about 1/1.

For example, the polyester resin may be obtained at a polymerization temperature of 180° C. or higher and 230° C. or lower. If needed, the pressure in the reaction system may be decreased, and the reaction may be carried out while removing water and alcohol generated during condensation. When the monomers do not dissolve or are not compatible with each other at a reaction temperature, the polymerization reaction may speed up or delayed partially, and many uncolored particles may be generated. Thus, a solvent having a high boiling point may be added and dissolved as a dissolving aid. The polycondensation reaction may be carried out while distilling away the dissolution-assisting solvent. In the copolymerization reaction, when monomers poorly compatible with each other are present, the poorly compatible monomer and an acid or alcohol to be subjected to polycondensation with that monomer may be preliminarily condensed, and then the resulting product may be subjected to polycondensation with the main component.

Examples of the catalyst that may be used in producing the polyester resin include compounds of alkali metals such as sodium and lithium; compounds of alkaline earth metals such as magnesium and calcium; compounds of metals such as zinc, manganese, antimony, titanium tin, zirconium, and germanium; and phosphorous acid compounds, phosphoric acid compounds, and amine compounds. Of these, for example, a tin-containing catalyst, such as tin, tin formate, tin oxalate, tetraphenyl tin, dibutyl tin dichloride, dibutyl tin oxide, or diphenyl tin oxide, may be used.

In this exemplary embodiment, a compound having a hydrophilic polar group may be used as long as it is co-polymerizable as a resin for the toner for developing electrostatic images. Assuming that the resin used is a polyester, specific examples of the compound include dicarboxylic acid compounds in which a sulfonyl group directly substitutes an aromatic ring, such as sulfonyl-sodium terephthalate salt and sodium 3-sulfonylisophthalate salt.

The weight-average molecular weight Mw of the polyester resin may be 10,000 or more or may be in the range of 25,000 or more and 50,000 or less. When such a polyester resin is contained, rub resistance is enhanced. When the weight-average molecular weight Mw of the polyester resin is below 5,000, separation readily occurs despite inclusion of a gel component in the toner; thus, issues (such as filming, an increase in the amount of fine powder due to brittleness, degradation of powder flowability, etc.) derived from the detached resin may arise.

The weight-average molecular weight (Mw) of the binder resin and the like is measured by gel permeation chromatography (GPC). The molecular weight measurement by GPC is conducted by using GPC·HLC-8120 produced by TOSOH CORPORATION as a measuring instrument with columns, TSKGEL Super HM-M (15 cm) produced by TOSOH CORPORATION, and a tetrahydrofuran (THF) solvent. The weight-average molecular weight described above is calculated from the measurement results by using the molecular weight calibration curves obtained from monodisperse polystyrene standard samples.

The toner of this exemplary embodiment may contain a resin other than the polyester resin. The resin other than the polyester resin is not particularly limited. Specific examples thereof include styrenes such as styrene, parachlorostyrene, and α-methylstyrene; acrylic monomers such as methyl acrylate, ethyl acrylate, n-propyl acrylate, n-butyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylenic unsaturated acid monomers such as acrylic acid, methacrylic acid, and sodium styrene sulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of olefinic monomers, such as ethylene, propylene, and butadiene, and copolymers and mixtures prepared by using two or more of these monomers; non-vinyl condensed resins such as epoxy resins, polyester resins, polyurethane resins, polyamide resins, cellulose resins, and polyether resins, and a mixture of any of the non-vinyl condensed resins and any of the vinyl resins; and graft polymers obtained by polymerizing a vinyl monomer in the presence of a non-vinyl condensed resin. These resins may be used alone or in combination.

The binder resin content relative to the entire toner is, for example, in the range of 80 mass % or more and 95 mass % or less.

The toner used in the image forming apparatus of this exemplary embodiment may contain a crystalline resin as the binder resin. When the toner contains a crystalline resin, the hygroscopic property is decreased further.

The crystalline resin content relative to the toner may be 3 wt % or more and 20 wt % or less or may be 5 wt % or more and 15 wt % or less. When the crystalline resin content relative to the toner is less than 3 wt %, the toner does not readily melt, and a higher fixing temperature is employed. Thus, low-temperature fixing is sometimes difficult. At a content exceeding 20 wt %, charge retaining properties may be degraded due to, for example, insufficient dispersion of the internal additives.

Other Constituent Components

The toner of this exemplary embodiment may contain other additives, such as a coloring agent, a releasing agent, a charge controller, and a metal oxide, as needed. These additives may be internally added by, for example, kneading with the binder resin, or may be externally added by, for example, a mixing process after obtaining toner particles.

The coloring agent is not particularly limited, and a known pigment is used. If needed, a known dye may be contained. Specific examples thereof include yellow, magenta, cyan, and black pigments described below.

Representative examples of the yellow pigment to be used include condensed azo compounds, isoindolinone compounds, anthraquinone compounds, azo metal complex compounds, methine compounds, and allylamide compounds.

Examples of the magenta pigments include condensed azo compounds, diketopyrrolopyrrole compounds, anthraquinone, quinacridone compounds, basic dye lake compounds, naphthol compounds, benzimidazolone compounds, thioindigo compounds, and perylene compounds.

Examples of the cyan pigments include copper phthalocyanine compounds and derivatives thereof, anthraquinone compounds, and basic dye lake compounds.

Examples of the black pigment include carbon black, aniline black, acetylene black, and iron black.

The coloring agent content relative to the entire toner is, for example, in the range of 5 mass % or more and 20 mass % or less.

The releasing agent is not particularly limited. Examples of the releasing agent include plant wax such as carnauba wax, wood wax, and rice bran wax; animal wax such as beeswax, insect wax, whale wax, and wool wax; mineral wax such as montan wax and ozokerite; synthetic fatty acid solid ester wax such Fischer Tropsch wax (FT wax) having an ester in a side chain, special fatty acid esters, and polyhydric alcohol esters; and synthetic wax such as paraffin wax, polyethylene wax, polypropylene wax, polytetrafluoroethylene wax, polyamide wax, and silicone compounds. These releasing agents may be used alone or in combination.

The releasing agent content relative to the entire toner is, for example, in the range of 0.1 mass % or more and 10 mass % or less.

The charge controller is not particularly limited, and a typical charge controller is used. Examples thereof include positive-charging charge controllers such as nigrosine dyes, fatty acid-modified nigrosine dyes, carboxyl group-containing fatty acid-modified nigrosine dyes, quaternary ammonium salts, amine compounds, amide compounds, imide compounds, and organic metal compounds; and negative-charging charge controllers such as metal complexes of oxycarboxylic acid, metal complexes of azo compounds, metal complex salt dyes, and salicylic acid derivatives. These charge controllers may be used alone or in combination.

The metal oxide is not particularly limited, and examples thereof include titanium oxide, aluminum oxide, magnesium oxide, zinc oxide, strontium titanate, barium titanate, magnesium titanate, and calcium titanate. These metal oxides may be used alone or in combination.

Properties of Toner

When the weight-average molecular weight and the number-average molecular weight of the tetrahydrofuran-soluble component of the toner used in the image forming apparatus of this exemplary embodiment measured by gel permeation chromatography are respectively assumed to be Mw and Mn, Mw may be 10,000 or more and 60,000 or less or may be 25,000 or more and 50,000 or less. When Mw is within this range, the toner has excellent fixability. When the weight-average molecular weight Mw of the tetrahydrofuran-soluble component of the toner measured by gel permeation chromatography is less than 10,000, the possibility of occurrence of hot offset during toner fixing increases. At a Mw exceeding 60,000, the lowest fixing temperature, in other words, the temperature at which the toner image does not separate when the substrate with the toner image formed thereon is bent, increases.

Mw/Mn may be 5 or more and 10 or less, or may be 6 or more and 8 or less. When Mw/Mn is less than 5, the technical difficulty of producing the binder resin increases, and the cost is increased. At Mw/Mn exceeding 10, the difference in fusibility relative to the fixing temperature is wide, the fixed image is likely to include unevenness, and the quality of the fixed image is deteriorated.

The molecular weight distribution curve, the average molecular weights, and the peak molecular weight in the GPC measurement of the tetrahydrofuran (THF)-soluble component of the toner particles are measured as follows.

First, 0.5 mg of toner particles (or the toner) to be measured is dissolved in 1 g of tetrahydrofuran (THF). The resulting mixture is ultrasonically dispersed, and adjusted to have a concentration of 0.5%. The dissolved component is then measured by GPC.

As a GPC system, "HLC-8120GPC, SC-8020 (product of TOSOH CORPORATION)" is used. Two columns, "TSK-GEL, SuperHM-H (product of TOSOH CORPORATION, 6.0 mm ID×15 cm)" are used. THF is used as an eluent. Experimental conditions are sample concentration: 0.5%, flow rate: 0.6 mL/min, sample injection amount: 10 μL, measurement temperature: 40° C., and experiments are conducted by using a refractive index (RI) detector. The calibration curves are prepared from ten samples of "polystyrene standard samples, TSK standard": "A-500", "F-1", "F-10", "F-80", "F-380", "A-2500", "F-4", "F-40", "F-128", and "F-700".

The amount of the toluene insoluble component in the toner particles may be 25 mass % or more and 45 mass % or less, may be 28 mass % or more and 38 mass % or less, or may be 30 mass % or more and 35 mass % or less. When the amount of the toluene insoluble component in the toner particles is within the above-described range, the hygroscopic property of the toner particles is decreased, and the transporting property of the toner particles is easily enhanced.

Here, the toluene insoluble component in the toner particles refers to a constituent component in the toner particles that is insoluble in toluene. In other words, the toluene insoluble component is an insoluble component that is mainly (for example, 50 mass % or more of the entirety) composed of toluene-insoluble components in the binder resin (in particular, high-molecular-weight components in the binder resin). The amount of the toluene insoluble component is regarded as the indicator of the amount of the crosslinked resin contained in the toner. The amount of the toluene insoluble component is the value measured by the following procedure.

Into a glass fiber cylindrical filter paper weighed, 1 g of toner particles (or toner) weighed are placed, and the filter paper is loaded in an extractor tube of a heating-type Soxhlet extractor. Toluene is poured into the flask, and heating is performed to 110° C. by using a mantle heater. A heater attached to the extraction tube is used to heat the periphery of the extraction tube to 125° C. Extraction is performed at a reflux rate such that one extraction cycle lasts 4 minutes or longer but 5 minutes or shorter. After extracting for 10 hours, the cylindrical filter paper and the toner residue are discharged, dried, and weighed. Then the amount (mass %) of the toner particle (or toner) residue is calculated from the formula: amount of toner particle (or toner) residue (mass %)=[(weight of cylindrical filter paper+amount of toner residue) (g)−weight of cylindrical filter paper (g)]÷mass (g) of toner particles (or toner)×100, and this amount (mass %) of the toner particle (or toner) residue is assumed to be the amount (mass %) of the toluene insoluble component.

The toner particle (or toner) residue is composed of inorganic matters, such as a coloring agent, external additives, high-molecular-weight components of the binder resin, etc. When the toner particles contain a releasing agent, the releasing agent constitutes the toluene-soluble component since extraction is performed under heating.

The amount of the toluene insoluble in the toner particles can be adjusted by, for example, the following methods that involves the binder resin: 1) a method involving adding a crosslinking agent to a polymer component having a terminal reactive functional group so as to form a crosslinked structure or a branched structure; 2) a method involving using polyvalent metal ions with a polymer component having a terminal ionic functional group so as to form a crosslinked structure or a branched structure; and 3) a method involving extending the resin chain length or forming branches by a treatment with an isocyanate or the like.

In the infrared absorption spectrum analysis of the toner, the ratio of the peak absorption at around 1500 $cm^{-1}$ to the peak absorption at around 720 $cm^{-1}$ may be 0.6 or less or may be 0.5 or less, and the ratio of the peak absorption at around 820 $cm^{-1}$ to the peak absorption at around 720 $cm^{-1}$ may be 0.4 or less or may be 0.3 or less. In the infrared absorption spectrum analysis of the toner of this exemplary embodiment, the ratio of the peak absorption at around 1500 $cm^{-1}$ to the peak absorption at around 720 $cm^{-1}$ may be 0.2 or more or may be 0.3 or more, and the ratio of the peak absorption at around 820 $cm^{-1}$ to the peak absorption at around 720 $cm^{-1}$ may be 0.05 or more or may be 0.08 or more. When the ratio of the peak absorption at around 1500 $cm^{-1}$ to the peak absorption at around 720 $cm^{-1}$ exceeds 0.6, the strength of the toner particles tends to decrease. At a ratio less than 0.2, the storage property of the toner particles may be degraded. When the ratio of the peak absorption at around 820 $cm^{-1}$ to the peak absorption at around 720 $cm^{-1}$ exceeds 0.4, the strength of the toner particles tends to decrease. At a ratio less than 0.05, the storage property of the toner particles may be degraded.

In the infrared absorption spectrum analysis of the toner, the ratio of the peak absorption at around 820 $cm^{-1}$ to the peak absorption at around 1500 $cm^{-1}$ may be 0.5 or less or may be 0.4 or less. In the infrared absorption spectrum analysis of the toner of this exemplary embodiment, the ratio of the peak absorption at around 820 $cm^{-1}$ to the peak absorption at around 1500 $cm^{-1}$ may be 0.1 or more or may be 0.15 or more. When the ratio of the peak absorption at around 820 $cm^{-1}$ to the peak absorption at around 1500 $cm^{-1}$ exceeds 0.5, the strength of the toner particles tends to decrease. At a ratio less than 0.1, the storage property of the toner particles may be degraded.

The peak absorptions (absorbances) at the respective wavelengths or wavenumbers in the infrared absorption spectrum analysis are measured by the following method. First, a measurement sample is prepared by a KBr tablet method from toner particles (or toner) to be measured. The measurement sample is analyzed with an infrared spectrophotometer (FT-IR-410 produced by JASCO Corporation) under the conditions of a number of scans of 300 and resolution of 4 $cm^{-1}$ within a wavenumber range of 500 $cm^{-1}$ or more and 4000 $cm^{-1}$ or less. Then the baseline correction is performed in an offset portion where absorbed light is absent, and the absorbance at each wavelength or wavenumber is determined. The terms such as "at around 720 $cm^{-1}$" "at around 820 $cm^{-1}$", and "at around 1500 $cm^{-1}$" respectively mean "720±20 $cm^{-1}$", "820±20 $cm^{-1}$", and "1500±20 $cm^{-1}$".

Here, the peak at around 720 $cm^{-1}$ is due to the bending vibration of the carbon-hydrogen bond (C-H bond) in an aliphatic chain, and is a peak derived from the aliphatic chain of the polyester resin. The peak at around 820 $cm^{-1}$ is due to the out-of-plane bending vibration of the carbon-hydrogen bond (C—H bond) in an aromatic ring, and is a peak derived from adjacent hydrogen atoms in the benzene ring of bisphenol when a bisphenol derivative, such as bisphenol A, is contained as a constituent component. The peak at around 1500 $cm^{-1}$ is due to the stretching vibration of the carbon-carbon bond (C═C bond) in an aromatic ring, and is a peak derived from a benzene ring of bisphenol when a bisphenol derivative, such as bisphenol A, is contained as a constituent component. The toner having peaks satisfying the above-described conditions in the infrared absorption spectrum is, for example, a toner that does not contain a bisphenol derivative, such as bisphenol A, as a constituent component, or a toner, the bisphenol derivative content of which is 5 mol % or less relative to all alcohol constituent components.

Figure 5:
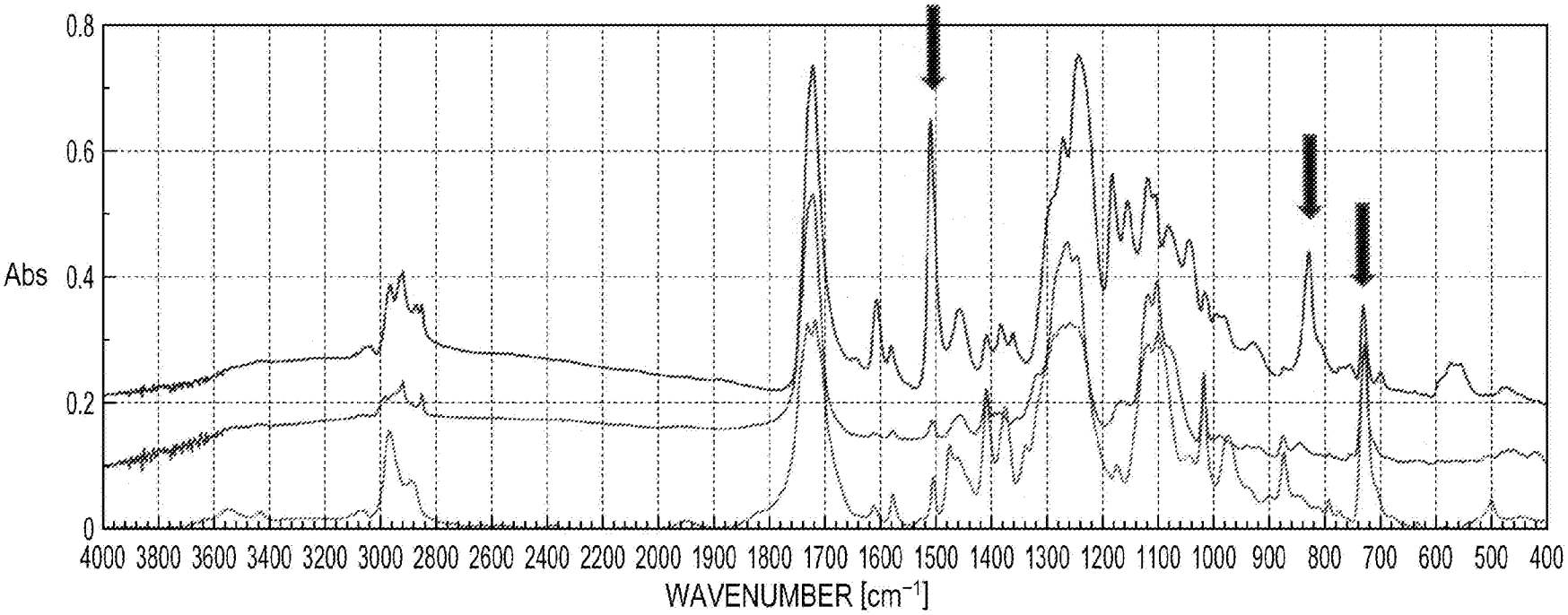
FIG. 5 a graph indicating examples of infrared absorption spectra of toners.

FIG. 5 a graph indicating examples of infrared absorption spectra of toners. In FIG. 5, the absorption peaks at around wavenumbers of 720 $cm^{-1}$, 820 $cm^{-1}$, and 1500 $cm^{-1}$ are respectively marked by arrows. In FIG. 5, examples of the infrared absorption spectra of toners in which the ratio of the peak absorption at about 1500 $cm^{-1}$ to the peak absorption at about 720 $cm^{-1}$ is 0.6 or less and the ratio of the peak absorption at about 820 $cm^{-1}$ to the peak absorption at about 720 $cm^{-1}$ is 0.4 or less are indicated in the lower part and the center part of the graph. An example of the infrared absorption spectrum of a toner in which the ratio of the peak absorption at about 1500 $cm^{-1}$ to the peak absorption at about 720 $cm^{-1}$ exceeds 0.6 and in which the ratio of the peak absorption at about 820 $cm^{-1}$ to the peak absorption at about 720 $cm^{-1}$ exceeds 0.4 is indicated in the upper part of the graph.

The volume-average particle diameter D50v of the toner may be 0.5 μm or more and 5.0 μm or less. When D50v is within this range, attaching force is strong, and the developing property is improved. Moreover, the resolution of the image is also improved. The volume-average particle diameter D50v of the toner may be in the range of 0.8 μm or more and 4.0 μm or less or may be in the range of 1.0 μm or more and 3.0 μm or less.

The volume-average particle diameter D50v of the toner, the number-average particle size distribution index (GSDp), the volume-average particle size distribution index (GSDv), etc., are measured by using a laser diffraction/scattering particle size distribution analyzer, for example, LA 920 (produced by HORIBA Ltd.). With respect to the particle size ranges (channels) divided on the basis of the particle size distribution, cumulative distributions of the volume and the number are plotted from the small diameter side. The particle diameters at 16% accumulation are defined as a volume D16v and a number D16p; the particle diameters at 50% accumulation are defined to be a volume D50v and a number D50p; and the particle diameters at 84% accumulation are defined as a volume D84v and a number D84p. By using these figures, the volume-average particle size distribution index (GSDv) is calculated by $(D84v/D16v)^{1/2}$, and the number-average particle size distribution index (GSDp) is calculated by $(D84p/D16p)^{1/2}$.

Method for Producing Toner

The method for producing the toner used in this exemplary embodiment is not particularly limited. Examples of the method include a kneading-pulverizing method, and wet methods such as an in-liquid emulsification method and a polymerization method.

For example, the binder resin and, optionally, a coloring agent and other additives are placed in a mixer such as a HENSCHEL mixer, and the resulting mixture is mixed and then melt-kneaded in a twin-screw extruder, a Banbury mixer, a roll mill, a kneader, or the like. The mixture is then cooled in a drum flaker or the like, roughly pulverized with a pulverizer such as a hammer mill, further pulverized with a pulverizer such as a jet mill, and classified with an air classifier or the like so as to obtain a pulverized toner.

For example, the binder resin and, optionally, a coloring agent and other additives are dissolved in a solvent, such as ethyl acetate, and the resulting solution is emulsified and suspended in water to which a dispersion stabilizer such as calcium carbonate is added, and, after the solvent is removed, the dispersion stabilizer is removed to obtain the particles. The particles are filtered and dried to obtain an in-liquid emulsified dry toner.

For example, a composition containing polymerizable monomers for forming the binder resin, a coloring agent, a polymerization initiator (for example, benzoyl peroxide, lauroyl peroxide, isopropyl peroxide carbonate, cumene hydroperoxide, 2,4-dichlorobenzoyl peroxide, or methyl ethyl ketone peroxide), and other additives is added to a water phase while stirring so as perform granulation. After the polymerization reaction, the particles are filtered and dried to obtain a polymerized toner.

The blend ratios of the materials (binder resin, coloring agent, and other additives) for obtaining the toner may be set by considering the desirable properties, low-temperature fixability, color, etc.

Developer

In this exemplary embodiment, the developer is not particularly limited except that the toner of this exemplary embodiment is contained, and an appropriate composition may be employed depending on the purpose. The developer in this exemplary embodiment is a one-component developer if only the toner is used, or is a two-component developer if the toner is used in combination with a carrier.

For example, when a carrier is used, the carrier is not particularly limited, and a known typical carrier may be used. Examples of the carrier include resin-coated carriers described in Japanese Laid Open Patent Application Publication Nos. 62-39879 and 56-11461, for example.

Specific examples of the carrier include the resin-coated carriers described below. Examples of the core particles of the carrier include typical iron powder, ferrite, and magnetite formed particles. The volume-average particle diameter is in the range of about 30 μm or more and about 200 μm or less.

Examples of the coating resin for the resin-coated carrier include homopolymers prepared from one of the following monomers and copolymers prepared from two or more of the following monomers: styrenes such as styrene, parachlorostyrene, and α-methylstyrene; α-methylene aliphatic acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinyl nitriles such as acrylonitrile and methacrylonitile; vinyl pyridines such as 2-vinyl pyridine and 4-vinylpyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; and vinyl-based fluorine-containing monomers such as vinylidene fluoride, tetrafluoroethylene, and hexafluoroethylene. Other examples include silicone resins such as methyl silicone and methyl phenyl silicone, polyesters containing bisphenol, glycol, etc., epoxy resins, polyurethane resins, polyamide resins, cellulose resins, polyether resins, and polycarbonate resins. These resins may be used alone or in combination. The coating amount of the coating resin may be in the range of about 0.1 parts by weight or more and about 10 parts by weight or less relative to 100 parts by weight of the core particles. The range may be 0.5 parts by weight or more and 3.0 parts by weight or less.

A heating-type kneader, a heating-type HENSCHEL mixer, a UM mixer, or the like may be used in producing the carrier. Depending on the amount of the coating resin, a heating-type fluidized bed, a heating-type kiln, or the like may be used.

In the developer, the mixing ratio between the carrier and the toner of the exemplary embodiment is not particularly limited, and may be appropriately selected according to the purpose.

Although exemplary embodiments of the invention have been described heretofore, the scope of the invention should not be interpreted as being limited to the exemplary embodiments described above. It should be understood that various modifications, alterations, and improvements are possible within the scope that satisfies the features of the present invention.

EXAMPLES

Examples and Comparative Examples are presented below to describe the invention in specific details, but the invention is not limited by these examples.

Measurement Method

The volume-average particle diameter D50v of the toner is measured by using a MULTISIZER II (aperture diameter: 50 μm, produced by Beckman Coulter Inc.). Specifically, from the particle size distribution measured by MULTISIZER II, volume cumulative distribution is plotted from the small diameter size for the divided particle size ranges (channels), and the particle diameter at 50% accumulation is assumed to be the D50v.

Preparation of Amorphous Polyester Resin (A1)

To a three-necked flask with a dried interior, 60 parts by mass of dimethyl terephthalate, 74 parts by mass of dimethyl fumarate, 30 parts by mass of dodecenylsuccinic anhydride, 22 parts by mass of trimellitic acid, 138 parts by mass of propylene glycol, and 0.3 parts by mass of dibutyltin oxide are added. In a nitrogen atmosphere, the temperature is elevated under stirring, and a reaction is performed at 185° C. for 3 hours while removing the water generated by the reaction to outside the system. Then the temperature is increased to 240° C. while gradually decreasing the pressure, the reaction is further continued for 4 hours, and then cooling is performed. As a result, an amorphous polyester resin (A1) having a weight-average molecular weight Mw of 39,000 is obtained.

Preparation of Amorphous Polyester Resin (A2)

An amorphous polyester resin (A2) is prepared by the same method as that for the amorphous polyester resin (A1) except that, after performing the reaction at 190° C. for 3 hours, the temperature is elevated to 220° C. while gradually decreasing the pressure, and the reaction is further conducted for 2.5 hours. The weight-average molecular weight Mw of the amorphous polyester resin (A2) is 26,000.

Preparation of Amorphous Polyester Resin (A3)

An amorphous polyester resin (A3) is prepared by the same method as that for the amorphous polyester resin (A1) except that 128 parts by mass of propylene glycol and 19 parts by mass of butylene glycol are used instead of 138 parts by mass of propylene glycol and that, after performing the reaction at 195° C. for 4 hours, the temperature is elevated to 240° C. while gradually decreasing the pressure, and the reaction is further conducted for 6 hours. The weight-average molecular weight Mw of the amorphous polyester resin (A3) is 56,000.

Preparation of Crystalline Polyester Resin (B1)

To a three-necked flask with a dried interior, 100 parts by mass of dimethyl sebacate, 67.8 parts by mass of hexanediol, and 0.10 parts by mass of dibutyltin oxide are added. In a nitrogen atmosphere, the temperature is elevated under stirring, and a reaction is performed at 185° C. for 5 hours while removing the water generated during the reaction to outside the system. Then the temperature is increased to 220° C. while gradually decreasing the pressure, the reaction is further continued for 6 hours, and then cooling is performed. As a result, a crystalline polyester resin (B1) having a weight-average molecular weight of 33,700 is obtained.

The melting temperature of this crystalline polyester resin (B1) is determined from the DSC curve obtained by differential scanning calorimetry (DSC) by the method described in "Melting peak temperature", which is one method for determining the melting temperature in JIS K 7121-1987 "Testing Methods for Transition Temperatures of Plastics". The melting temperature is 71° C.

Preparation of Amorphous Polyester Resin (A4)

An amorphous polyester resin (A4) is prepared as with the amorphous polyester resin (A1) except that 60 parts by mass of dimethyl terephthalate, 74 parts by mass of dimethyl fumarate, 30 parts by mass of dodecenylsuccinic anhydride, 22 parts by mass of trimellitic acid, 137 parts by mass of bisphenol A ethylene oxide adduct, 191 parts by mass of bisphenol A propylene oxide adduct, and 0.3 parts by mass of dibutyltin oxide are used. The weight-average molecular weight Mw of the amorphous polyester resin (A4) is 27,000.

Preparation of Toner (1)

Into a HENSCHEL mixer (produced by NIPPON COKE & ENGINEERING. CO., LTD.), 73 parts by mass of the amorphous polyester resin (A1), 6 parts by mass of the crystalline polyester resin (B1), 7 parts by mass of a coloring agent (C.I. Pigment Red 122), and releasing agents, namely, 5 parts by mass of paraffin wax (melting temperature: 73° C., produced by Nippon Seiro Co., Ltd.) and 2 parts by mass of ester wax (behenyl behenate, UNISTER M-2222SL produced by NOF CORPORATION), are placed, and the resulting mixture is stirred and mixed at a peripheral velocity of 15 m/second for 5 minutes. The resulting mixture is melted and kneaded in an extruder-type continuous kneader. The setting conditions of the extruder-type continuous kneader are: supply side temperature: 160° C., delivery side temperature: 130° C., supply side temperature of cooling roller: 40° C., and delivery side temperature of cooling roller: 25° C. The temperature of the cooling belt is set to 10° C.

After the melted and kneaded mixture is cooled, the cooled mixture is roughly pulverized by using a hammer mill, finely pulverized to a volume-average particle diameter of 6.5 μm by using a jet-type grinder (produced by Nippon Pneumatic Mfg. Co., Ltd.), and then classified by using an elbow-jet classifier (model EJ-LABO produced by Nittetsu Mining Co., Ltd.) so as to remove fine powder and rough powder and to thereby obtain a toner (1). The volume-average particle diameter of the toner (1) is 7.0 μm.

The content of the tetrahydrofuran-soluble component in the toner (1) is measured by GPC. The weight-average molecular weight Mw is 37,000, the number-average molecular weight Mn is 5,000, and the peak molecular weight is 9,500. Thus, Mw/Mn is calculated to be 7.4. From the infrared absorption spectrum of the toner (1), the ratio (A/C) of the peak absorption (A) at around 1500 $cm^{-1}$ to the peak absorption (C) at around 720 $cm^{-1}$, the ratio (B/C) of the peak absorption (B) at around 820 $cm^{-1}$ to the peak absorption (C) at around 720 $cm^{-1}$, and the ratio (B/A) of the peak absorption (B) at around 820 $cm^{-1}$ to the peak absorption (A) at around 1500 $cm^{-1}$ are calculated. A/C is 0.5, B/C is 0.1, and B/A is 0.3. Moreover, the toluene insoluble component content of the toner (1) is 34 mass %.

Preparation of Toner (2)

A toner (2) is prepared as with the toner (1) except that the amorphous polyester resin (A1) is changed to the amorphous polyester resin (A2). The volume-average particle diameter of the toner (2) is 6.8 μm. The toner (2) has a weight-average molecular weight Mw of 25,000, a number-average molecular weight Mn of 3,000, a peak molecular weight of 7,000, and Mw/Mn of 8.3. The toner (2) has A/C of 0.6, B/C of 0.2, and B/A of 0.3. Moreover, the toluene insoluble component content of the toner (2) is 28 mass %.

Preparation of Toner (3)

A toner (3) is prepared as with the toner (1) except that the amorphous polyester resin (A1) is changed to the amorphous polyester resin (A3). The volume-average particle diameter of the toner (3) is 7.5 μm. The toner (3) has a weight-average molecular weight Mw of 60,000, a number-average molecular weight Mn of 8,500, a peak molecular weight of 11,000, and Mw/Mn of 7.1. The toner (3) has A/C of 0.5, B/C of 0.2, and B/A of 0.4. Moreover, the toluene insoluble component content of the toner (3) is 38 mass %.

Preparation of Toner (4)

A toner (4) is prepared as with the toner (1) except that no crystalline resin is used and the amount of the amorphous polyester resin (A1) is changed to 79 parts by mass. The volume-average particle diameter of the toner (4) is 7.1 μm. The toner (4) has a weight-average molecular weight Mw of 39,000, a number-average molecular weight Mn of 4,500, a peak molecular weight of 9,800, and Mw/Mn of 8.7. The toner (4) has A/C of 0.6, B/C of 0.1, and B/A of 0.3. Moreover, the toluene insoluble component content of the toner (4) is 33 mass %.

Preparation of Toner (5)

A toner (5) is prepared as with the toner (4) except that the amorphous polyester resin (A1) is changed to the amorphous polyester resin (A4). The volume-average particle diameter of the toner (5) is 7.7 μm. The toner (5) has a weight-average molecular weight Mw of 27,000, a number-average molecular weight Mn of 5,000, a peak molecular weight of 7,500, and Mw/Mn of 5.4. The toner (5) has A/C of 3.0, B/C of 1.7, and B/A of 0.6. Moreover, the toluene insoluble component content of the toner (5) is 31 mass %.

Preparation of Developer

Each developer is obtained by mixing 8 parts by mass of one of the toners described above and 100 parts by mass of a carrier by using a V blender. Here, the carrier is obtained by first preparing a coating solution by dispersing 14 parts by mass of toluene and 2 parts by mass of styrene-methyl methacrylate copolymer (component ratio (molar ratio): styrene/methyl methacrylate=90/10, weight-average molecular weight Mw=80,000) for 10 minutes in a stirrer to prepare a coating solution, placing 100 parts by mass of ferrite particles (volume-average particle diameter: 50 μm) and the coating solution into a vacuum deaerator-type kneader (produced by INOUE MFG., INC.), mixing the resulting mixture at 60° C. for 30 minutes, reducing the pressure and performing deaeration while heating, drying the resulting mixture, and then classifying the resulting mixture with a 105 μm sieve.

Fixing Test

Examples 1 to 4

The toners (1) to (4), and an image forming apparatus (modified model of DOCUCENTRE-V3070 produced by Fuji Xerox Co., Ltd.) equipped with the fixing device illustrated in FIG. 1 are used, and a fixing test is conducted in a 28° C., 85 RH % high-temperature, high-humidity environment at a fixing temperature of 160° C. by performing output on A3-size sheets (produced by Fuji Xerox Co., Ltd.). An endless belt having an elastic layer (composed of filler-blended fluororesin, thickness: 0.03 mm) formed at the contact surface with the heat roll is used as the endless belt. For hot offset, a chart is used in which a patch image having a toner mass per unit area (TMA) of 5 g/m$^2$ is formed on a leading end side of the sheet, and the trailing end side is left blank without any image formed therein. This image is repeatedly formed on 10 sheets for sampling, whether black spots (discharge of toner lumps on the image) exist or not is confirmed by naked eye, and separation (offset) of the toner in the patch portion and the re-fixability to the blank portion are evaluated by the following standards for the fixability. The results are indicated in Table.

The rub resistance is evaluated by the following procedure. A chart, in which a patch image having a toner mass per unit area (TMA) of 5 g/m$^2$ is formed on a leading end side of the sheet, and the trailing end side is left blank without any image formed therein, is output on three sheets. Another blank sheet is superimposed so as to oppose the fixed image (the sheets are arranged so that the fixed image lies on the upper surface and the blank page comes on the lower surface), and the two sheets are held between 10 k gauss magnets. Here, the magnet that lies on the lower surface is fixed. Subsequently, the sheet subjected to fixing is allowed to slide so that the fixed image passes between the magnets. The blank paper held between the magnets is checked to visually check attachment of the toner, and evaluation is conducted according to the following standard. The results are indicated in Table.

Hot Offset

A: No toner separation (image omission) in the patch portion or no re-fixing in the blank portion.

B: No toner separation (image omission) in the patch portion, but slight re-fixing in the blank portion.

C: Toner separation (image omission) in the patch portion and re-fixing in the blank portion.

Rub Resistance

A: No toner attachment to the blank sheet

B: Toner attached to the blank sheet, but no separation of fixed image

C: Toner extensively attached to the blank sheet, and separation of fixed image observed Comparative Example 1

Evaluation is conducted as in Examples 1 to 4 except that the toner (1) is used, and an image forming apparatus (DocuCentre-V5080 produced by Fuji Xerox Co., Ltd.) equipped with a fixing device having a heating roll and a pressure roll is used. The results are indicated in Table.

Reference Example 1

Evaluation is conducted as in Examples 1 to 4 except that the toner (5) is used. The results are indicated in Table.

Example 5

Evaluation is conducted as in Example 1 except that an endless belt that does not have an elastic layer at the contact surface with the heat roll is used as the endless belt. The results are indicated in Table.

Example 6

Evaluation is conducted as in Example 1 except that an image forming apparatus (produced by Fuji Xerox Co., Ltd.) equipped with a fixing device illustrated in FIG. 3 is used. The results are indicated in Table.

TABLE 1

| | Developer (toner) | | | | | | | | | | | | | | | |
|---|---|---|---|---|---|---|---|---|---|---|---|---|---|---|---|---|
| | | | Molecular weight properties of toner particles | | | | Infrared absorption spectral properties of toner particles | | | | | | | | Evaluation | |
| | Toner | Binder resin | Mw | Mn | Mw/Mn | Peak molecular weight | Absorbance A at a wavenumber of 1500 cm$^{-1}$ | Absorbance B at a wavenumber of 820 cm$^{-1}$ | Absorbance C at a wavenumber of 720 cm$^{-1}$ | A/C | B/C | B/A | Toluene insoluble component of toner particles (mass %) | Fixing device | Hot offset | Rub resistance |
| Example 1 | (1) | (A1) + (B1) | 37000 | 5000 | 7.4 | 9500 | 0.07 | 0.02 | 0.15 | 0.5 | 0.1 | 0.3 | 34 | FIG. 1 | A | A |
| Example 2 | (2) | (A2) + (B1) | 25000 | 3000 | 8.3 | 7000 | 0.12 | 0.04 | 0.20 | 0.6 | 0.2 | 0.3 | 28 | FIG. 1 | B | A |
| Example 3 | (3) | (A3) + (B1) | 60000 | 8500 | 7.1 | 11000 | 0.05 | 0.02 | 0.11 | 0.5 | 0.2 | 0.4 | 38 | FIG. 1 | A | B |
| Example 4 | (4) | (A1) | 39000 | 4500 | 8.7 | 9800 | 0.08 | 0.02 | 0.14 | 0.6 | 0.1 | 0.3 | 33 | FIG. 1 | A | A |
| Example 5 | (1) | (A1) + (B1) | 37000 | 5000 | 7.4 | 9500 | 0.07 | 0.02 | 0.15 | 0.5 | 0.1 | 0.3 | 34 | FIG. 1* | A | B |

TABLE 1-continued

| | Developer (toner) | | | | | | | | | | | | | | | |
|---|---|---|---|---|---|---|---|---|---|---|---|---|---|---|---|---|
| | | | Molecular weight properties of toner particles | | | | Infrared absorption spectral properties of toner particles | | | | | | | | | |
| | Toner | Binder resin | Mw | Mn | Mw/Mn | Peak molecular weight | Absorbance A at a wavenumber of 1500 $cm^{-1}$ | Absorbance B at a wavenumber of 820 $cm^{-1}$ | Absorbance C at a wavenumber of 720 $cm^{-1}$ | A/C | B/C | B/A | Toluene insoluble component of toner particles (mass %) | Fixing device | Evaluation: Hot offset | Evaluation: Rub resistance |
| Example 6 | (1) | (A1) + (B1) | 37000 | 5000 | 7.4 | 9500 | 0.07 | 0.02 | 0.15 | 0.5 | 0.1 | 0.3 | 34 | FIG. 3 | A | B |
| Comparative Example 1 | (1) | (A1) + (B1) | 37000 | 5000 | 7.4 | 9500 | 0.07 | 0.02 | 0.15 | 0.5 | 0.1 | 0.3 | 34 | 2 roll | C | A |
| Reference Example 1 | (5) | (A4) | 27000 | 5000 | 5.4 | 7500 | 0.90 | 0.50 | 0.30 | 3.0 | 1.7 | 0.6 | 31 | FIG. 1 | A | B |

*An endless belt not having an elastic layer at a surface that contacts a heat roll is used.

As described above, in these Examples, when a toner, which contains a polyester resin as a binder resin, has a toner tetrahydrofuran-soluble component having a Mw of 10,000 or more and 60,000 or less and a Mw/Mn of 5 or more and 10 or less, and has a ratio of a peak absorption at around 1500 $cm^{-1}$ to a peak absorption at around 720 $cm^{-1}$ of 0.6 or less and a ratio of a peak absorption at around 820 $cm^{-1}$ to a peak absorption at around 720 $cm^{-1}$ of 0.4 or less in infrared absorption spectrum analysis, is used in a high-temperature, high-humidity environment, the fixing latitude can be enlarged compared to when a fixing device equipped with a heating roll and pressure roll is used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic image forming unit that forms an electrostatic image on the charged surface of the image holding member;

a developing unit that contains an electrostatic image developer and develops the electrostatic image on the surface of the image holding member by using the electrostatic image developer so as to form a toner image;

a transfer unit that transfers the toner image on the surface of the image holding member onto a surface of a recording medium; and a fixing unit that fixes the toner image on the recording medium, wherein, the electrostatic image developer contains a toner, the toner contains a binder resin containing:

i) a crystalline resin, and ii) an amorphous polyester resin, in which an amount of alkylene oxide adducts of bisphenol A, if present, is not more than 5 mol % relative to all alcohol constituent components of the amorphous polyester resin, a tetrahydrofuran-soluble component of toner particles has a weight-average molecular weight Mw in a range of 25,000 to 60,000, and a ratio Mw/Mn of the weight-average molecular weight Mw to a number-average molecular weight Mn of the tetrahydrofuran-soluble component is within a range of 5 to 10, a ratio of an absorbance of the toner particles at a wavenumber of 1500 $cm^{-1}$ to an absorbance of the toner particles at a wavenumber of 720 $cm^{-1}$ is 0.6 or less, a ratio of an absorbance of the toner particles at a wavenumber of 820 $cm^{-1}$ to the absorbance of the toner particles at a wavenumber of 720 $cm^{-1}$ is 0.4 or less, and the fixing unit includes:

a heat roll that has an elastic component and is rotatable, an endless belt that contacts the heat roll, and a pressure pad that is disposed on an inner side of the endless belt and is in a non-rotatable state.

2. The image forming apparatus according to claim 1, wherein the ratio of the absorbance of the toner particles at a wavenumber of 1500 cm to the absorbance of the toner particles at a wavenumber of 720 $cm^{-1}$ is 0.5 or less, and the ratio of the absorbance of the toner particles at a wavenumber of 820 $cm^{-1}$ to the absorbance of the toner particles at a wavenumber of 720 $cm^{-1}$ is 0.3 or less.

3. The image forming apparatus according to claim 1, wherein a ratio of the absorbance of the toner particles at a wavenumber of 820 $cm^{-1}$ to the absorbance of the toner particles at a wavenumber of 1500 $cm^{-1}$ is 0.5 or less.

4. The image forming apparatus according to claim 1, wherein the tetrahydrofuran-soluble component of the toner particles has a peak molecular weight in a range of 7,000 to 11,000.

5. The image forming apparatus according to claim 1, wherein a toluene insoluble component content of the toner particles is in a range of 28 mass % to 38 mass %.

6. The image forming apparatus according to claim 1, wherein a content of the crystalline resin relative to a total amount of the toner is in a range of 3 mass % to 20 mass %.

7. The image forming apparatus according to claim 1, wherein the endless belt has an elastic layer at a contact surface with the heat roll.

8. The image forming apparatus according to claim 7, wherein the fixing unit further includes a guide member disposed on two end portions in a longitudinal direction of the endless belt, the guide member rotatably supporting an inner circumferential surface of the endless belt.

9. The image forming apparatus according to claim 1, wherein the pressure pad forms a belt nip between the endless belt and the heat roll so that the recording medium is allowed to pass through the belt nip, and locally elastically deform an outlet side of the recording medium in the heat roll.

* * * * *